US009033741B2

(12) United States Patent
Su et al.

(10) Patent No.: US 9,033,741 B2
(45) Date of Patent: May 19, 2015

(54) CONNECTOR OF A LIGHT-EMITTING-DIODE LAMP TUBE

(71) Applicants: Justing Technology(Taiwan) PTE Ltd., Zhongli, Taoyuan County (TW); Justing Technology PTE. Ltd., Singapore (SG)

(72) Inventors: Chia-Ching Su, Taoyuan (TW); Chih-Yuan Yen, Taoyuan (TW)

(73) Assignees: JUSTING TECHNOLOGY(TAIWAN) PTE LTD., Zhongli, Taoyuan County (TW); JUSTING TECHNOLOGY PTE. LTD., Singapore (SG)

( * ) Notice: Subject to any disclaimer, the term of this patent is extended or adjusted under 35 U.S.C. 154(b) by 128 days.

(21) Appl. No.: 14/021,024

(22) Filed: Sep. 9, 2013

(65) Prior Publication Data

US 2014/0087571 A1 Mar. 27, 2014

(30) Foreign Application Priority Data

Sep. 27, 2012 (TW) ..... 101135539 A

(51) Int. Cl.

| | |
|---|---|
| ***F21V 33/00*** | (2006.01) |
| ***H01R 13/11*** | (2006.01) |
| ***F21K 99/00*** | (2010.01) |
| ***F21S 4/00*** | (2006.01) |
| ***F21V 23/06*** | (2006.01) |
| ***H01R 12/70*** | (2011.01) |
| ***H01R 33/08*** | (2006.01) |
| *H01R 12/72* | (2011.01) |

(52) U.S. Cl.

CPC ..... *H01R 13/111* (2013.01); *F21K 9/175* (2013.01); *F21S 4/008* (2013.01); *F21V 23/06* (2013.01); *H01R 12/7088* (2013.01); *H01R 12/724* (2013.01); *H01R 33/0854* (2013.01)

(58) Field of Classification Search

CPC ..... H01J 5/60
USPC ..... 439/612, 80, 79; 362/249.02
See application file for complete search history.

(56) References Cited

U.S. PATENT DOCUMENTS

| | | | | | |
|---|---|---|---|---|---|
| 2,958,065 | A * | 10/1960 | Flanagan, Jr. | ..... | 439/381 |
| 3,179,912 | A * | 4/1965 | Huber et al. | ..... | 439/581 |
| 4,003,617 | A * | 1/1977 | Witek et al. | ..... | 439/80 |
| 4,310,211 | A * | 1/1982 | Bunnell et al. | ..... | 439/358 |
| 5,904,415 | A * | 5/1999 | Robertson et al. | ..... | 362/260 |
| 6,123,587 | A * | 9/2000 | Beloritski et al. | ..... | 439/857 |
| 6,644,984 | B2 * | 11/2003 | Vista et al. | ..... | 439/76.1 |

(Continued)

*Primary Examiner* — Neil Abrams
(74) *Attorney, Agent, or Firm* — Jackson IPG PLLC; Demian K. Jackson

(57) ABSTRACT

By a simple insertion operation, a connector forms electric conduction by contact, and is therefore applied to a fluorescent lamp tube, a power-saving lamp tube or a similar lamp tube. A light-emitting-diode lamp tube of the present invention includes a light module and two end caps. The connector connects the two end caps at two ends of the light module, and is composed of an insulator body, a conductive plate and a connection terminal. The insulator body includes an insertion slot, the connection terminal is disposed in the insertion slot to connect with the conductive plate, and includes two elastic terminal units. By inserting directly a conductive terminal of the end cap into the connector, and forming electric conduction by contact with each elastic terminal unit, electricity is transmitted, thereby constituting a structure that can be assembled easily, and parts thereof can be replaced and repaired by an ordinary person.

16 Claims, 9 Drawing Sheets

(56) References Cited

U.S. PATENT DOCUMENTS

| | | | | |
|---|---|---|---|---|
| 6,994,564 | B1 * | 2/2006 | Kan | 439/63 |
| 7,029,291 | B2 * | 4/2006 | Chen | 439/79 |
| 7,497,715 | B2 * | 3/2009 | Wu | 439/329 |
| 7,534,146 | B2 * | 5/2009 | Chien et al. | 439/668 |
| 7,594,738 | B1 * | 9/2009 | Lin et al. | 362/249.02 |
| 8,021,192 | B2 * | 9/2011 | Takata | 439/628 |
| 8,157,408 | B2 * | 4/2012 | Yang et al. | 362/217.13 |
| 8,177,388 | B2 * | 5/2012 | Yen | 362/217.01 |
| 8,220,956 | B2 * | 7/2012 | Lai et al. | 362/218 |
| 8,232,724 | B2 * | 7/2012 | Mostoller et al. | 313/512 |
| 8,297,788 | B2 * | 10/2012 | Bishop | 362/249.02 |
| 8,388,172 | B2 * | 3/2013 | Yue et al. | 362/219 |
| 8,523,394 | B2 * | 9/2013 | Simon et al. | 362/249.05 |
| 8,628,342 | B2 * | 1/2014 | Tremblay et al. | 439/236 |
| 8,827,486 | B2 * | 9/2014 | Lai et al. | 362/218 |
| 8,928,025 | B2 * | 1/2015 | Simon et al. | 257/99 |
| 2010/0277918 | A1 * | 11/2010 | Chen et al. | 362/249.02 |
| 2011/0235320 | A1 * | 9/2011 | Cai et al. | 362/217.17 |
| 2014/0022776 | A1 * | 1/2014 | Su et al. | 362/218 |
| 2014/0036491 | A1 * | 2/2014 | Su et al. | 362/217.17 |
| 2014/0087571 | A1 * | 3/2014 | Su et al. | 439/57 |
| 2014/0096378 | A1 * | 4/2014 | Su et al. | 29/832 |
| 2014/0286004 | A1 * | 9/2014 | Su et al. | 362/218 |

* cited by examiner

CONNECTOR OF A LIGHT-EMITTING-DIODE LAMP TUBE

BACKGROUND OF THE INVENTION a) Field of the Invention

The present invention relates to a connector of a light-emitting-diode lamp tube, and more particularly to a connector by which a user can utilize a simple insertion operation to form electric conduction by contact. Therefore, the connector is able to be applied to a fluorescent lamp tube, a power-saving lamp tube or a similar lamp tube.

b) Description of the Prior Art

An early fluorescent lamp tube is mostly made of glass and contains small amount of mercury. Therefore, one should be very careful when taking or installing the fluorescent lamp tube; if the fluorescent lamp tube is broken accidentally, the mercury will flow out and damage the environment. In addition, if a person touches or adsorbs the mercury by accident, then he or she may be poisoned. On the other hand, although a conventional fluorescent lamp is cheaper, its wastes can result in mercury pollution or the fluorescent lamp can be fragile.

For a new generation of the fluorescent lamp, an LED (Light Emitting Diode) is used to give out light, but the structure is still the same as the early design of the fluorescent lamp, so as to be used in an early lamp bracket.

Referring to FIG. 1, an ordinary LED lamp tube includes a hollow tube 11, a light emitting module 12 and two external modules 13, wherein the hollow tube 11 contains a base 110 that is covered by a lampshade 111. The light emitting module 12 is provided with a circuit board 120 and plural LEDs 121 disposed on that circuit board 120. In addition, the circuit board 120 is provided with a circuit that is connected electrically with the LEDs 121, and two connecting blocks 123 are disposed in proximity to two sides of the circuit board 120. The two external modules 13 are assembled at two ends of the hollow tube 11, and each external module 13 is provided with an end cap 130, a fixing block 131 and two terminals. The end cap 130 is assembled on the base 110 with a bolt 133 and the fixing block 131 is screwed on the base 110 with another bolt 133. Each terminal includes a latch block 136 and a conductive pillar 137. The latch block 136 is latched into the fixing block 131, and a side of the latch block 136 is exposed from a lower side of the fixing block 131 and is welded with the connecting block 123 on an exterior side of the circuit board 120. The conductive pillar 137 is extended from an end surface of the latch block 136 and is protruded outward from the end cap 130.

However, the prior art is provided with following shortcomings:

1. The assembling process of the external modules is tedious and complicated; therefore, the assembling cost is higher.
2. The quality of welding is difficult to be determined by naked eyes; therefore, tiny cracks may be formed. Moreover, if the levels of welders are not consistent, the welding quality can be affected easily, thereby increasing the defective fraction.
3. An ordinary LED lamp tube is still used in a conventional lamp holder. Therefore, when an LED lamp tube is inserted into a connecting seat of a conventional lamp holder, the LED lamp tube must be rotated by 90 degrees to be energized. Accordingly, the area of irradiation of the LED lamp tube will be deviated by 90 degrees, which prohibits an area below the LED lamp tube from being irradiated.

SUMMARY OF THE INVENTION

Accordingly, the primary object of the present invention is to provide a connector by which a user can utilize a simple insertion operation to form electric conduction by contact, so that the connector is able to be applied to a fluorescent lamp tube, a power-saving lamp tube or a similar lamp tube.

To achieve the abovementioned object, the lamp tube of the present invention is provided with a light module and two end caps, and the connector is used to connect the two end caps at an end side of the light module respectively. The connector includes at least an insulator body, a conductive plate and a connection terminal. The insulator body is provided with an insertion slot, and the connection terminal is disposed in the insertion slot and is connected with the conductive plate.

The connection terminal is provided at least with two elastic terminal units which are inserted directly into the connector through a conductive terminal of each end cap, and form electric conduction by contact with each elastic terminal unit to transmit electricity, thereby constituting a structure that can be assembled easily, and parts thereof can be replaced and repaired by an ordinary person.

By the abovementioned primary characteristics of structures, a bottom of the said insulator body is provided at least with a protruded positioning pillar.

By the abovementioned primary characteristics of structures, two sides of the said insulator body are formed respectively with an opening for transfixing with a welding unit of the conductive plate.

By the abovementioned primary characteristics of structures, an annular connecting unit is formed between a second conducting unit and each elastic terminal unit.

By the abovementioned primary characteristics of structures, the said connection terminal is provided with three elastic terminal units, and each elastic terminal unit is separated with the other by an included angle of 120°.

By the abovementioned primary characteristics of structures, a first conducting unit is provided with a through-hole for sheathing with the second conducting unit of the connection terminal.

By the abovementioned primary characteristics of structures, a slide positioning structure is further disposed between the lamp tube and the end cap. The slide positioning structure is provided at least with a rib and an annular slot for holding the rib; whereas, two sides of the rib are provided with a groove. By locking the rib with the annular slot, the lamp tube and the end cap can be positioned.

By the abovementioned primary characteristics of structures, the said rib is disposed on an inner annular wall of the end cap and the annular slot is disposed on an outer surface of the lamp tube in proximity to two end sides.

By the abovementioned primary characteristics of structures, the said rib is disposed on the outer surface of the lamp tube in proximity to two end sides, and the annular slot is disposed on the inner annular wall of the end cap.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
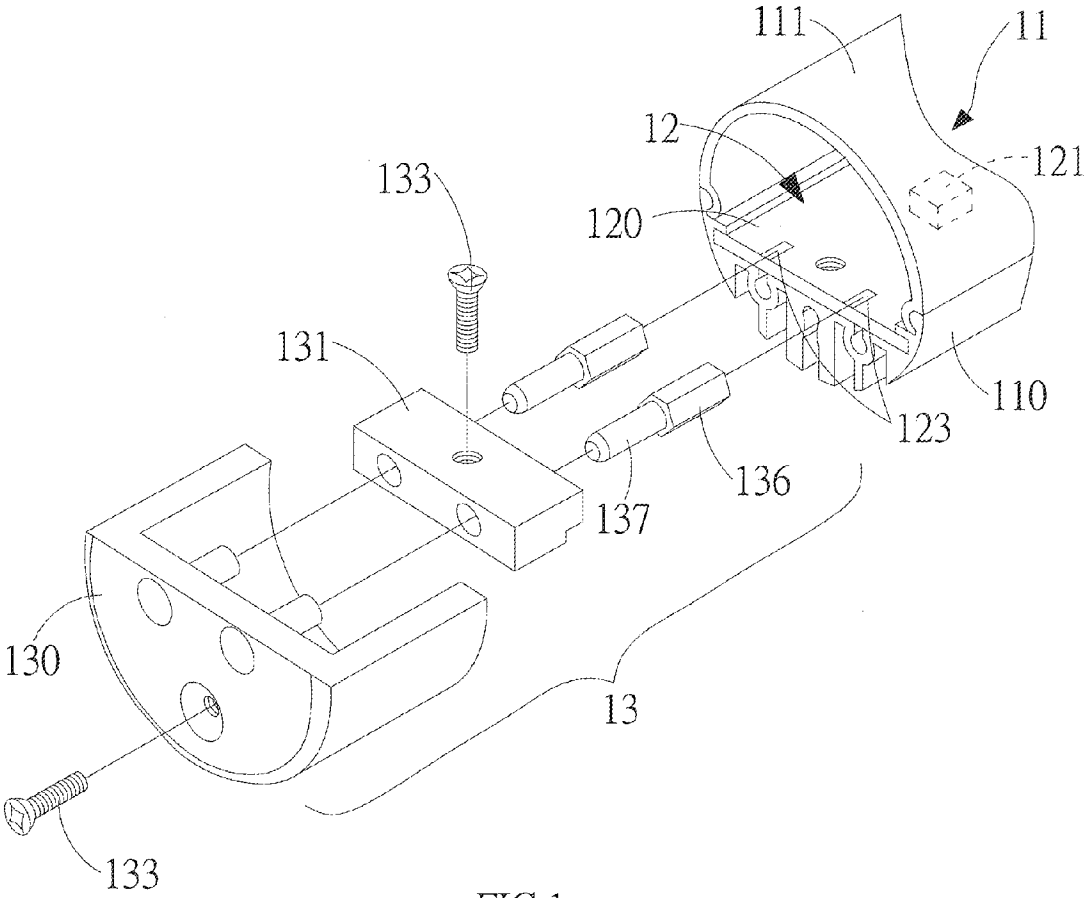
FIG.1 PRIOR ART
FIG. 1 shows an exploded structural view of a conventional LED lamp tube.
Figure 2:
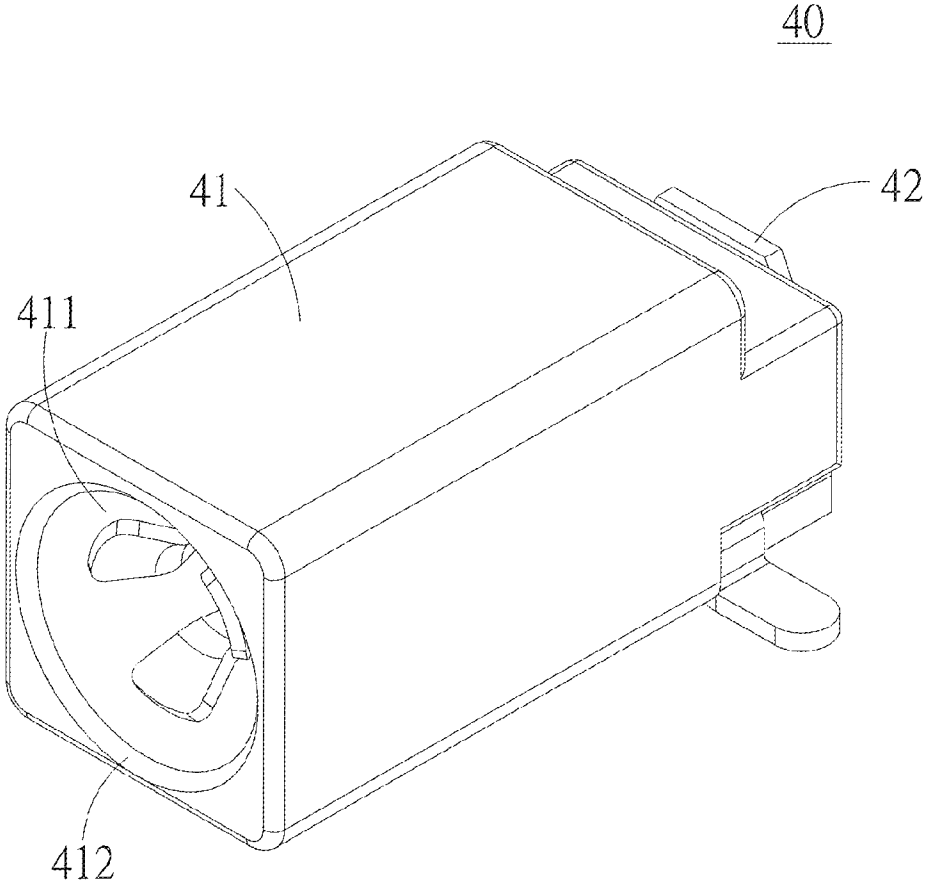
FIG. 2 shows a three-dimensional structural view of a connector of a preferred embodiment, according to the present invention.
Figure 3:
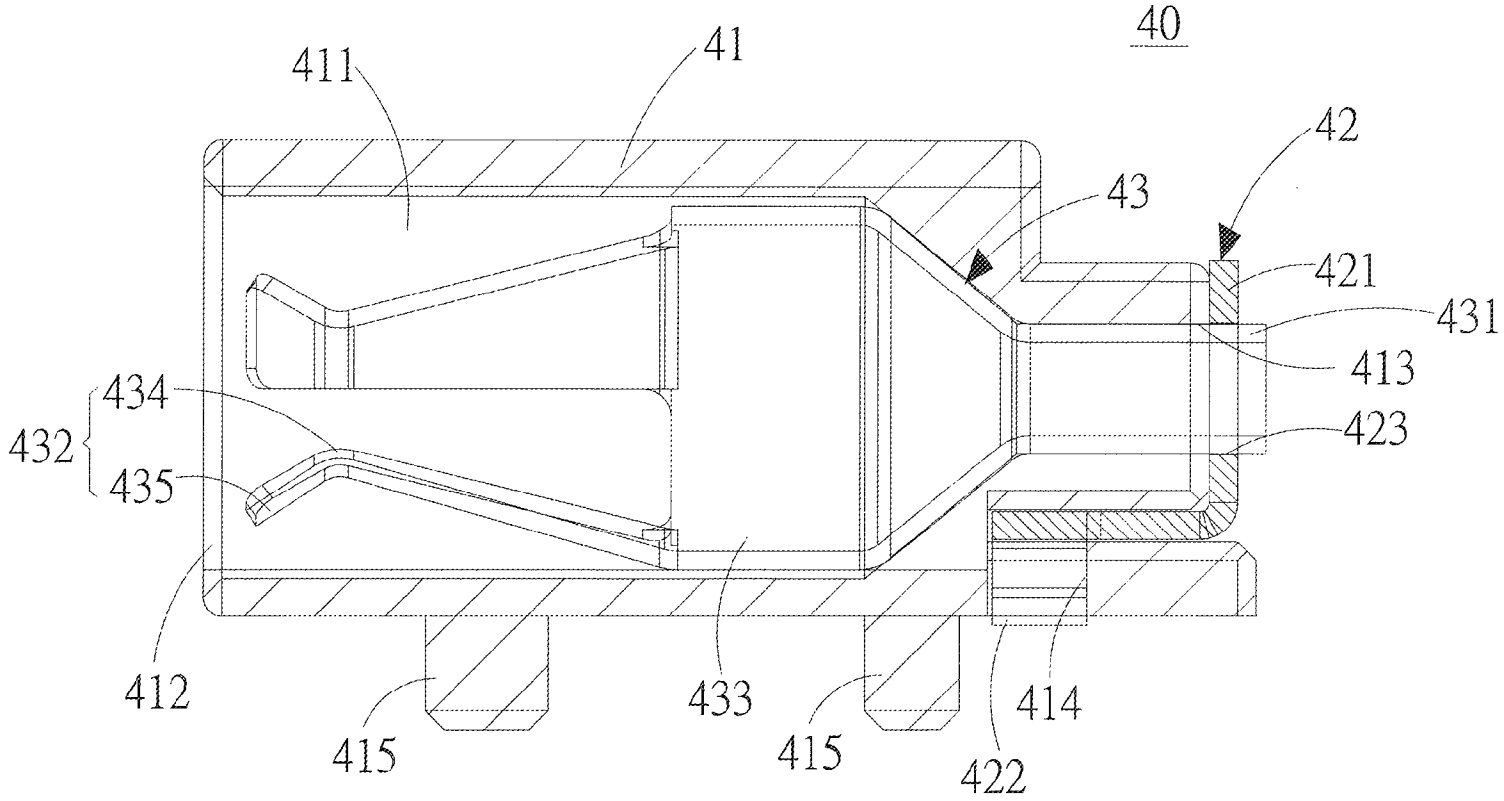
FIG. 3 shows a cutaway structural view of the connector of the preferred embodiment, according to the present invention.

FIG. 2 discloses a three-dimensional structural view of a connector of a preferred embodiment, according to the present invention; whereas, FIG. 3 shows a cutaway structural view of the connector of the preferred embodiment, according to the present invention. The connector 40 comprises at least an insulator body 41, a conductive plate 42 and a connection terminal 43.

Figure 4:
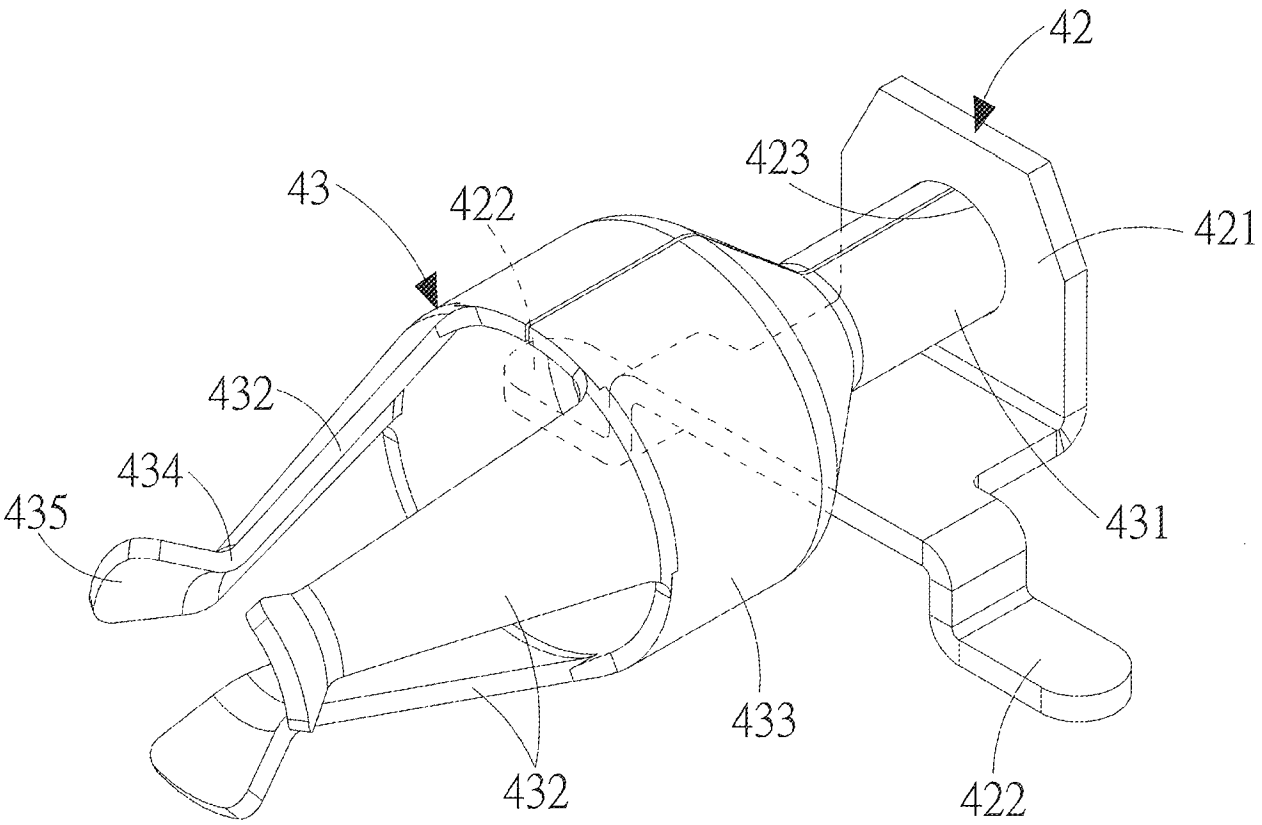
FIG. 4 shows a three-dimensional structural view of a conductive plate and a connection terminal of the preferred embodiment, according to the present invention.

The insulator body 41 is provided with an insertion slot 411, and a front end of the insertion slot 411 is formed with an insertion port 412. Referring to FIG. 4 at a same time, a rear end of the insertion port 412 is formed with an open pore 413 and two sides of the insulator body 41 are formed respectively with an opening 414 which is connected with the insertion slot 411.

The conductive plate 42 is disposed on the insulator body 41 corresponding to the open pore 413, the conductive plate 42 is provided with a first conducting unit 421 at the open pore 413, and a welding unit 422 which is extended from a side of the first conducting unit 421 to a side of the insulator body 41, with the welding unit 422 being transfixed out of the opening 414.

The connection terminal 43 is disposed in the insertion slot 411 and is provided with a second conducting unit 431 which is connected with the first conducting unit 421. The second conducting unit 431 is also extended toward the insertion port 412 with at least two elastic terminal units 432. As shown in the drawings, the connection terminal 43 is provided with three elastic terminal units 432, and each elastic terminal unit 432 is separated with the other by an included angle of 120°. An annular connecting unit 433 is formed between the second conducting unit 431 and each elastic terminal unit 432, and each elastic terminal unit 432 is formed with an indented connecting unit 434 and an expansion unit 435, a tail end of which is expanded outward. The first conducting unit 421 is provided with a through-hole 423 for sheathing with the second conducting unit 431 of the connection terminal 43.

Figure 5:
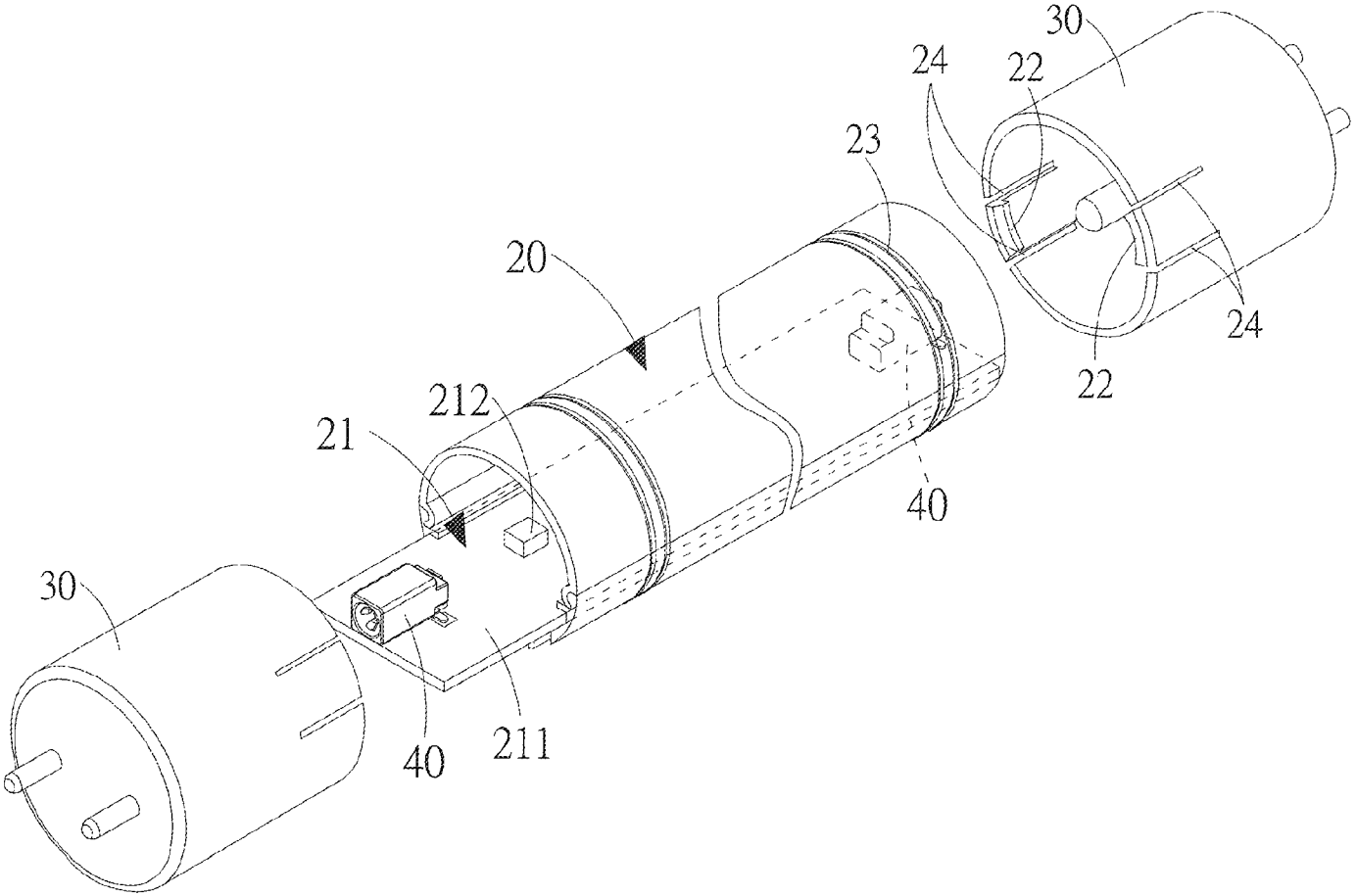
FIG. 5 shows an exploded structural view of a lamp tube of the preferred embodiment, according to the present invention.
Figure 6:
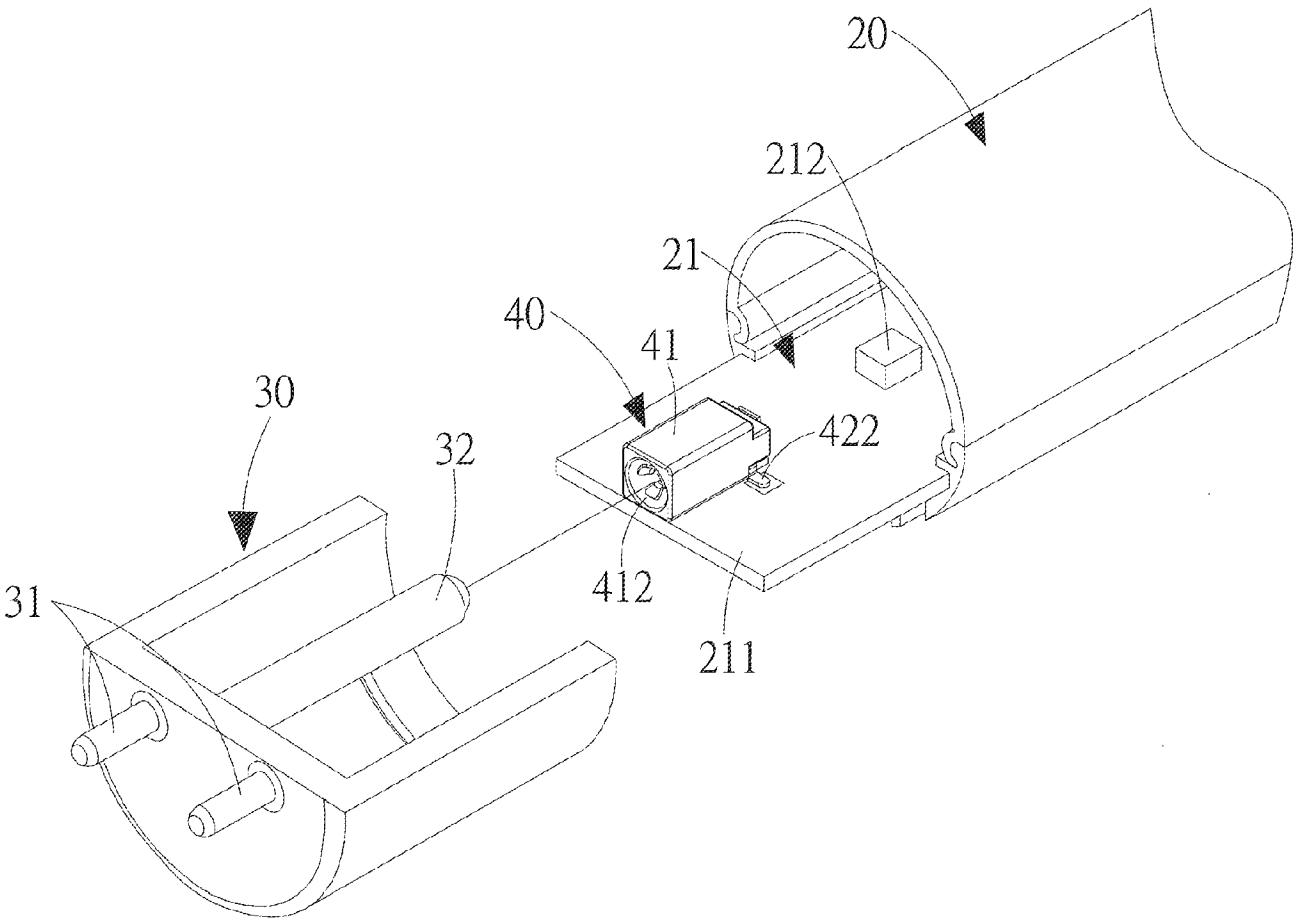
FIG. 6 shows an exploded and enlarged structural view of the lamp tube of the preferred embodiment, according to the present invention.

Referring to FIG. 5 and FIG. 6, a light-emitting-diode lamp tube is provided primarily with a lamp tube 20, and an interior of the lamp tube 20 is provided with a light module 21. The light module 21 is provided with a circuit board 211 and plural LEDs 212 disposed on the circuit board 211. Two end caps 30 are disposed on the lamp tube 20 at an end side opposite to the circuit board 211, respectively. Each end cap 30 is provided with two electrical terminals 31, and an interior side of each end cap 30 is provided respectively with a conductive terminal 32. The conductive terminal 32 is connected with the electrical terminal 31, and the connector 40 is used to constitute electric connection between the end cap 30 and the circuit board 211.

Figure 7:
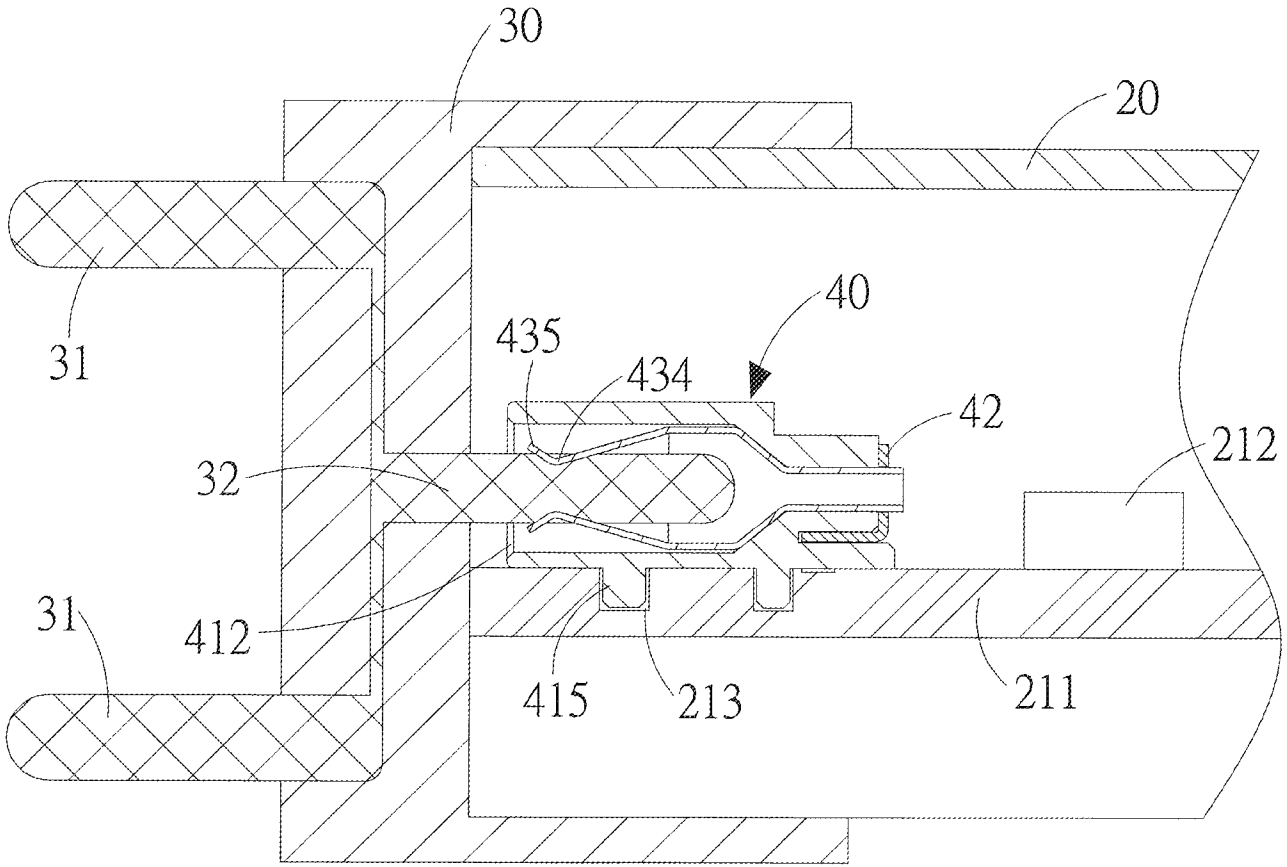
FIG. 7 shows a cutaway structural view of the lamp tube of the preferred embodiment, according to the present invention.

Upon assembling, the connector 40 is emplaced on the circuit board 211 of the light module 21 and the insertion port 412 is made to face toward an exterior side of the circuit board 211. The connector 40 is welded on the circuit board 211 by the welding units 422 of the conductive plate 42, thereby constituting electric connection between the connector 40 and the circuit board 211. Referring to FIG. 7 at a same time, when the end cap 30 is to be inserted into the connector 40, the conductive terminal 32 of the end cap 30 is inserted from the insertion port 412, with that the expansion unit 435 of the elastic terminal unit 432 is first expanded outward roughly to facilitate keeping the conductive terminal 32 to move toward a rear end until the conductive terminal 32 is positioned. At this time, the indented connecting unit 434 is connected electrically with the conductive terminal 32. In addition, a bottom of the insulator body 41 is provided at least with a protruded positioning pillar 415, and the circuit board 211 is provided at least with a positioning hole 213 to hold the positioning pillar 415, allowing the connector 40 to be positioned on the circuit board 211 more stably.

When the lamp tube of the present invention is inserted into a conventional lamp holder, the electrical terminal 31 and the conductive terminal 32 of the end cap 30 will form a current loop with the circuit board 211 by the connector 40, allowing the LEDs 212 to give out light by receiving electricity. Accordingly, with a simple insertion operation, the end cap can be assembled with the lamp tube, such that the end cap and the lamp tube can be assembled, repaired and detected easily, and parts thereof can be replaced easily, thereby increasing the practicability.

Moreover, a slide positioning structure is further disposed between the lamp tube 20 and the end cap 30. As shown in FIG. 5, the slide positioning structure is provided at least with a rib 22 and an annular slot 23 that can hold the rib 22; whereas, two sides of the rib 22 are provided with a groove 24 respectively. In the embodiment shown in the drawings, the rib 22 is disposed on an inner annular wall of the end cap 30, and the annular slot 23 is disposed on an outer surface of the lamp tube 20 in proximity to two end sides. Each groove 24 provides the rib 22 with elasticity to facilitate emplacing the rib 22 in the annular slot 23; whereas, by locking the rib 22 with the annular slot 23, the lamp tube 20 and the end cap 30 can be positioned.

Figure 8:
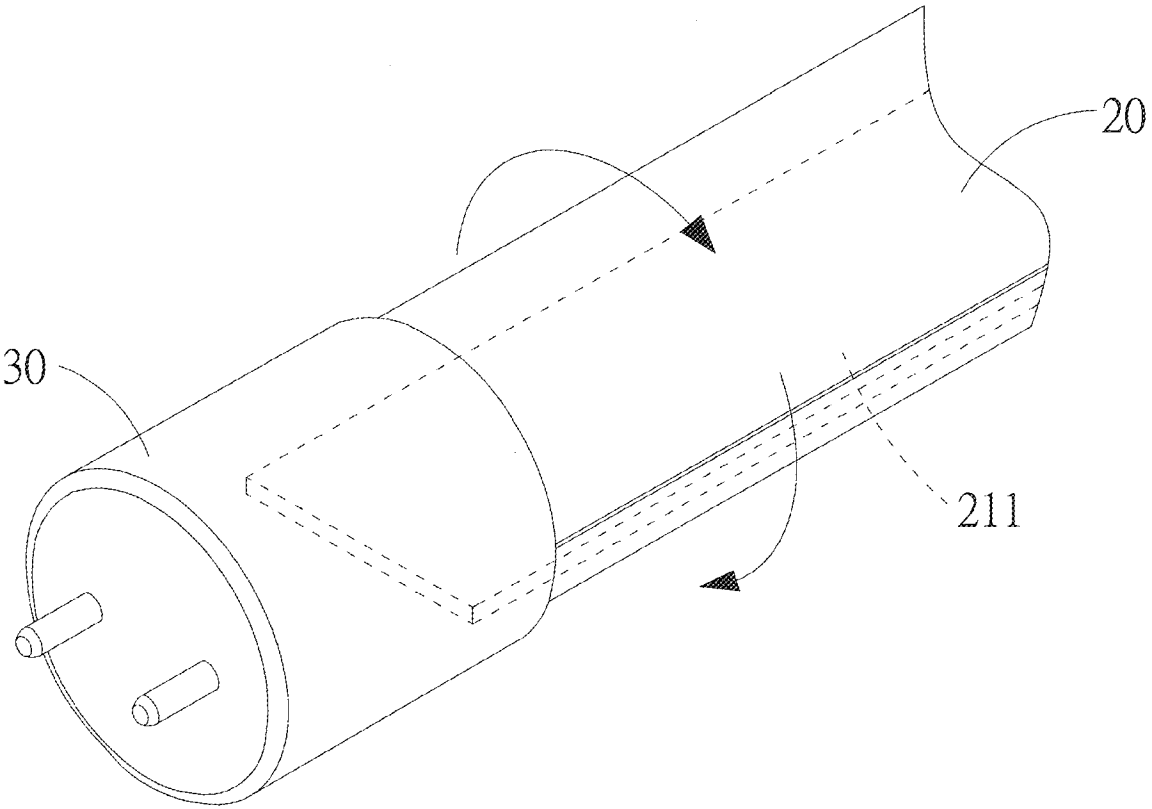
FIG. 8 shows a schematic structural view of an end cap which rotates by 360° relative to the lamp tube, according to the present invention.

When the lamp tube of the present invention is inserted into a conventional lamp holder and a current loop is formed, the rib 22 can slide inside the annular slot 23, such that the lamp tube 20 can rotate by 360° relative to the end cap 30, as shown in FIG. 8. Therefore, the lamp tube 20 and the circuit board 211 can rotate by a corresponding orientation to adjust an angle of irradiation.

Figure 9:
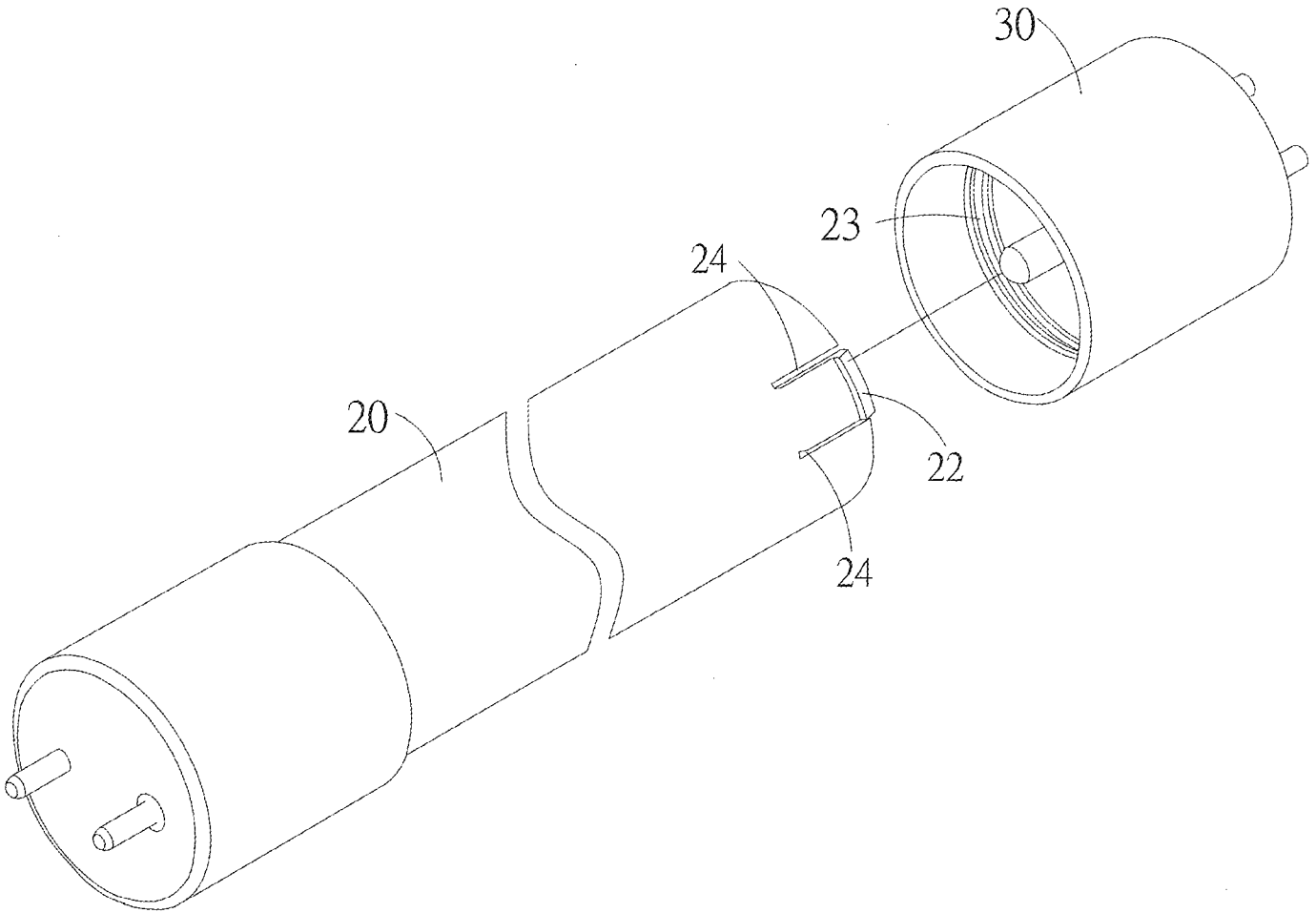
FIG. 9 shows a three-dimensional structural view of another embodiment of a slide positioning structure, according to the present invention.

On the other hand, the rib 22 can be also disposed on the outer surface of the lamp tube 20 in proximity to two end sides, and the annular slot 23 is disposed on the inner annular wall of the end cap 30, as shown in FIG. 9. This configuration also enables the lamp tube 20 and the end cap 30 to be positioned and rotate with respect to each other.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A connector of a light-emitting-diode lamp tube, the light-emitting-diode lamp tube being provided with a lamp tube, an interior of the lamp tube being provided with a light module, the light module being provided with a circuit board and plural light emitting diodes disposed on the circuit board, two end caps being disposed respectively at an end side of the lamp tube opposite to the circuit board, each end cap being provided with two electrical terminals, an interior side of each end cap being provided with a conductive terminal, the conductive terminal being connected with the electrical terminal, a connector being disposed on the circuit board to form electric connection, and the connector comprising:

an insulator body, the insulator body is provided with an insertion slot, with a front end of the insertion slot being formed with an insertion port, and a rear end of the insertion slot being formed with an open pore;

a conductive plate, the conductive plate is disposed on the insulator body corresponding to the open pore, with the conductive plate being provided with a first conducting unit at the open pore, and a welding unit extending from a side of the first conducting unit toward a side of the insulator body; and a connection terminal, the connection terminal is disposed in the insertion slot and is provided with a second conducting unit to connect with the first conducting unit, with the second conducting unit extending toward the insertion port with two elastic terminal units, each elastic terminal unit being formed with an indented connecting unit and an expansion unit, and a tail end of the expansion unit being expanded outward.

2. The connector of a light-emitting-diode lamp tube, according to claim 1, wherein a bottom of the insulator body is provided with a protruded positioning pillar.

3. The connector of a light-emitting-diode lamp tube, according to claim 1, wherein two sides of the insulator body are formed respectively with an opening for transfixing with a welding unit of the conductive plate.

4. The connector of a light-emitting-diode lamp tube, according to claim 2, wherein two sides of the insulator body are formed respectively with an opening for transfixing with a welding unit of the conductive plate.

5. The connector of a light-emitting-diode lamp tube, according to claim 3, wherein an annular connecting unit is formed between the second conducting unit and each elastic terminal unit.

6. The connector of a light-emitting-diode lamp tube, according to claim 4, wherein an annular connecting unit is formed between the second conducting unit and each elastic terminal unit.

7. The connector of a light-emitting-diode lamp tube, according to claim 3, wherein the connection terminal is provided with three elastic terminal units, and each elastic terminal unit is separated with the other by an included angle of 120°.

8. The connector of a light-emitting-diode lamp tube, according to claim 4, wherein the connection terminal is provided with three elastic terminal units, and each elastic terminal unit is separated with the other by an included angle of 120°.

9. The connector of a light-emitting-diode lamp tube, according to claim 3, wherein the first conducting unit is provided with a through-hole for sheathing with the second conducting unit of the connection terminal.

10. The connector of a light-emitting-diode lamp tube, according to claim 4, wherein the first conducting unit is provided with a through-hole for sheathing with the second conducting unit of the connection terminal.

11. The connector of a light-emitting-diode lamp tube, according to claim 3, wherein a slide positioning structure is disposed between the lamp tube and the end cap, the slide positioning structure is provided with a rib and an annular slot for holding the rib, two sides of the rib are provided with a groove, and by locking the rib with the annular slot, the lamp tube and the end cap are positioned.

12. The connector of a light-emitting-diode lamp tube, according to claim 4, wherein a slide positioning structure is disposed between the lamp tube and the end cap, the slide positioning structure is provided with a rib and an annular slot for holding the rib, two sides of the rib are provided with a groove, and by locking the rib with the annular slot, the lamp tube and the end cap are positioned.

13. The connector of a light-emitting-diode lamp tube, according to claim 11, wherein the rib is disposed on an inner annular wall of the end cap, and the annular slot is disposed on an outer surface of the lamp tube in proximity to two end sides.

14. The connector of a light-emitting-diode lamp tube, according to claim 12, wherein the rib is disposed on an inner annular wall of the end cap, and the annular slot is disposed on an outer surface of the lamp tube in proximity to two end sides.

15. The connector of a light-emitting-diode lamp tube, according to claim 11, wherein the rib is disposed on an outer surface of the lamp tube in proximity to two end sides, and the annular slot is disposed on an inner annular wall of the end cap.

16. The connector of a light-emitting-diode lamp tube, according to claim 12, wherein the rib is disposed on an outer surface of the lamp tube in proximity to two end sides, and the annular slot is disposed on an inner annular wall of the end cap.

* * * * *